United States Patent [19]

Bickford

[11] 4,117,614

[45] Oct. 3, 1978

[54] ADJUSTABLE PICTURE FRAMES

[75] Inventor: Edgar Bickford, Danbury, Conn.

[73] Assignee: The Raymond Lee Organization, Inc., New York, N.Y.

[21] Appl. No.: 742,187

[22] Filed: Nov. 16, 1976

[51] Int. Cl.[2] ..... G09F 1/12

[52] U.S. Cl. ..... 40/155

[58] Field of Search ..... 40/155, 152, 158

[56] References Cited

U.S. PATENT DOCUMENTS

| | | | |
|---|---|---|---|
| 1,253,847 | 1/1918 | Lynch | 40/152 |
| 1,261,133 | 4/1918 | Kidd | 40/158 R |
| 2,790,259 | 4/1957 | Havens | 40/155 |
| 2,866,286 | 12/1958 | Hartnan | 40/152 X |
| 3,570,160 | 3/1971 | Spertus | 40/152 |
| 3,886,677 | 6/1975 | Behring et al. | 40/158 R |

FOREIGN PATENT DOCUMENTS

| | | | |
|---|---|---|---|
| 654,290 | 11/1928 | France | 40/155 |
| 380,070 | 9/1932 | United Kingdom | 40/155 |

*Primary Examiner*—Louis G. Mancene
*Assistant Examiner*—Wenceslao J. Contreras
*Attorney, Agent, or Firm*—Howard I. Podell

[57] ABSTRACT

An adjustable picture frame assembly kit consisting of four frame legs, a front transparent panel, a rear panel, an easel and a tube of plastic glue. Each of the frame legs is in the form of a rectangular corner section, with two of the frame legs shaped to telescopically slide over the other two legs when oriented as the two diagonally opposed corners of a picture frame. The rear panel is scored with tear lines so as to simplify cutting to size, in use.

1 Claim, 7 Drawing Figures

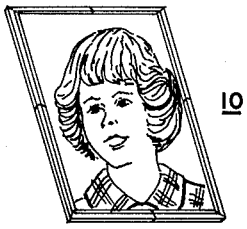
FIG. 1
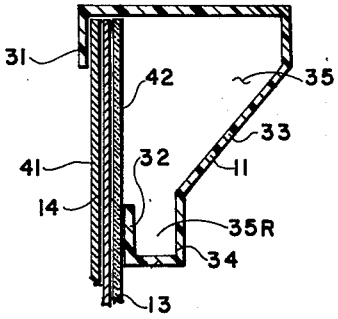
FIG. 3
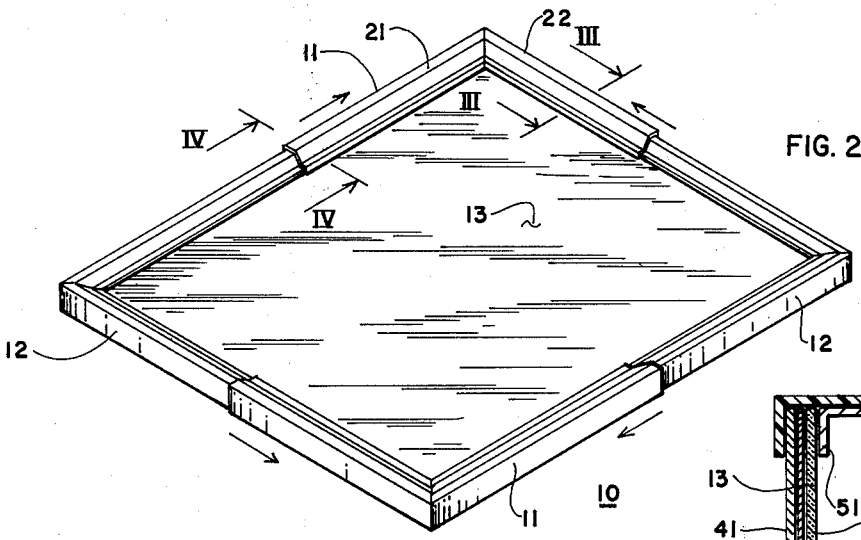
FIG. 2
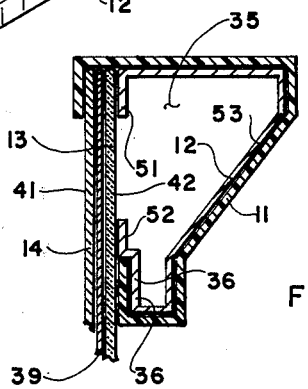
FIG. 4
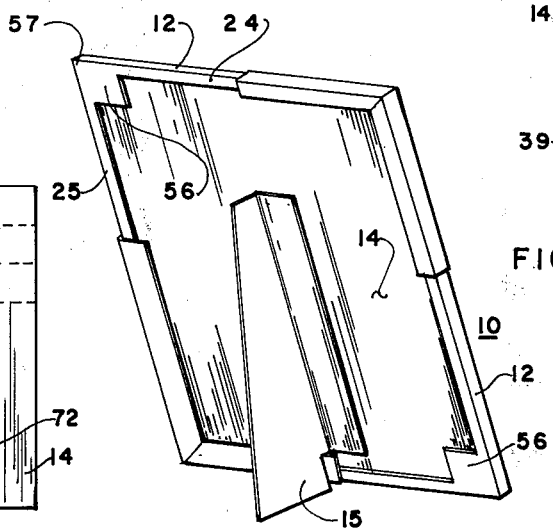
FIG. 5
FIG. 6
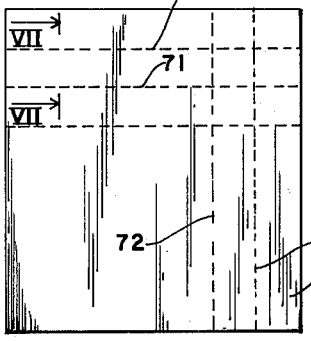
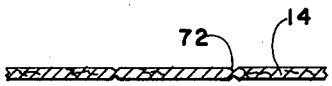
FIG. 7

ADJUSTABLE PICTURE FRAMES

SUMMARY OF THE INVENTION

My invention is an adjustable picture frame assembly kit consisting of four frame legs, a front transparent panel, a rear panel, an easel and a tube of plastic glue. Each of the frame legs is in the form of a rectangular corner section, with two of the frame legs shaped to telescopically slide over the other two legs when oriented as the two diagonally opposed corners of a picture frame. The rear panel is scored with tear lines so as to simplify cutting to size, in use.

BRIEF DESCRIPTION OF THE DRAWINGS

The objects and features of the invention may be understood with reference to the following detailed description of an illustrative embodiment of the invention, taken together with the accompanying drawings in which:

FIG. 1 is a perspective view of the assembled invention in use;

FIG. 2 is a perspective view of the assembled invention;

FIG. 3 is a sectional view of the assembled invention, taken along line III—III of FIG. 2;

FIG. 4 is a sectional view of the assembled invention, taken along line IV—IV of FIG. 2, FIG. 5 is a rear perspective view of the assembled invention;

FIG. 6 is a top view of the rear panel of the invention; and

FIG. 7 is a section view of the rear panel, taken along line VII—VII of FIG. 6.

DESCRIPTION OF THE PREFERRED EMBODIMENT

Turning now descriptively to the drawings, in which similar reference characters denote similar elements throughout the several views, FIGS. 1 and 5 illustrate a picture frame 10 assembled from a kit of parts that include two units of a first frame section 11 and two units of a second frame section 12 together with a front transparent panel 13, a rear opague section 14 and an easel stand 15.

Frame sections 11 and 12 are each formed as corner sections of a picture frame, with section 11 shaped to telescopically engage frame sections 12 when assembled so that the area of the frame 10 bounded by assembled section 11 and 12 may be varied, with two frame sections 12 and two frame sections 11 serving respectively as diagonally opposed corner sections of the assembled frame 10.

Frame section 11 is formed as an open channel member of two mutually perpendicular arm members 21 and 22, each of a uniform cross-section, as shown in FIG. 3 formed of a back leg section 31 that rests when assembled against the front face 42 of front panel 13, with leg sections 31 joined by a shaped intermediate section 33 that encloses an interior recess 35 in which telescopically engaged frame section 12 may extend as shown in FIG. 4. Intermediate section 33 is formed at its lower section in an L-shaped section 34 that joins leg section 32 to form a rectangular shaped U-section enclosing a rectangular shaped recessed portion 35R of recess 35.

Frame section 12 is formed as an open channel member of two mutually perpendicular arm members 24 and 25 each of uniform cross-section, except as noted hereinafter, as shown in FIG. 3, formed in section of an upper front leg section 51 and a lower front leg section 52 that each rest, when assembled against the front face 42 of front panel 13, with leg sections 51 and 52 joined by an intermediate section 53 of a shape to fit inside recess 35 of frame section 11. Leg section 52 is joined to a rectangular U-shaped section 36 of section 53 of a shape to fit inside of recess section 35R abutting leg section 32 and L-shaped section 34 of frame 11.

A tab section 56 extends from the corner joint 57 of arm members 24 and 25 behind the rear face 41 of rear panel 14 so that in the assembled condition the telescoped frame section 11 and 12 press rear panel 14 and front panel 13 against a picture 39 mounted between panels 13 and 14.

Rear panel 14 is formed of an opague material formed with straight horizontal and vertical score lines 71 and 72 respectively on both faces of panel 14 to permit the user to tear or cut panel 14 to one of a desired conventional rectangular shape prior to mounting.

Panel 13 is formed of transparent sheet which may be cut to size using the shaped size of panel 14 as a template.

An easel stand 15 is glued to the exterior surface 41 of rear panel 14.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A kit for forming a picture frame to one of many desired sizes comprising a rear panel, and two pairs of frame sections, with each pair of frame sections formed of two mutually perpendicular arm sections, each formed as an open channel member, and with each arm section of the first pair of frame sections shaped to telescopically slide over an arm section of one of the second pair of frame sections, each said frame section shaped to abut, in the assembled condition a front face of a panel mounted in said frame sections and a rear face of a panel mounted in said frame section, in which each arm section of each first frame section is shaped with a pair of projecting sections that extend for substantially the length of the respective arm section, with one of said projecting sections of each arm section formed to abut the front face of a panel mounted in the frame section and the other of said projecting sections of each arm section formed to abut the rear face of a panel mounted in the frame section, and in which each second frame section is formed with a projecting section that extends for substantially the length of each arm section, with said projecting section shaped to abut the front face of a panel mounted in the said frame section, together with a tab section on the joint of the two arm sections, which tab section is shaped to abut the rear face of a panel mounted in the said frame section.

* * * * *